US009493906B2

(12) United States Patent
Werkman et al.

(10) Patent No.: US 9,493,906 B2
(45) Date of Patent: Nov. 15, 2016

(54) THIN-FILM HEATING ELEMENT

(75) Inventors: Pieter Johannes Werkman, Singapore (SG); Roel Rethmeier, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 2054 days.

(21) Appl. No.: 10/579,647

(22) PCT Filed: Nov. 11, 2004

(86) PCT No.: PCT/IB2004/052382

§ 371 (c)(1),
(2), (4) Date: Jan. 23, 2009

(87) PCT Pub. No.: WO2005/051042

PCT Pub. Date: Jun. 2, 2005

(65) Prior Publication Data

US 2009/0114639 A1 May 7, 2009

(30) Foreign Application Priority Data

Nov. 20, 2003 (EP) ..... 03078688

(51) Int. Cl.

| | |
|---|---|
| ***H05B 3/26*** | (2006.01) |
| ***H05B 3/16*** | (2006.01) |
| ***D06F 75/24*** | (2006.01) |

(52) U.S. Cl.

CPC ..... *D06F 75/24* (2013.01); *H05B 3/262* (2013.01); *Y10T 29/49083* (2015.01)

(58) Field of Classification Search

CPC ..... H01C 17/02; H01C 17/06; H01C 17/00; H05B 2203/017; H05B 2203/013; H05B 3/84

USPC ..... 219/543, 444.1, 544, 546, 548, 552, 219/553; 428/1.51, 1.6–1.62, 70, 447, 448, 428/450, 688, 689; 29/610.1, 611, 620

See application file for complete search history.

(56) References Cited

U.S. PATENT DOCUMENTS

| | | | | |
|---|---|---|---|---|
| 3,459,924 | A * | 8/1969 | McMichael | F24H 1/101 165/180 |
| 3,811,934 | A * | 5/1974 | Glaser | H05B 3/06 205/186 |
| 4,021,640 | A * | 5/1977 | Gross | A41D 19/01535 2/159 |
| 4,547,655 | A * | 10/1985 | Kurata | B62D 1/065 219/204 |
| 4,665,308 | A * | 5/1987 | Courvoisier | A43B 3/0005 219/211 |
| 4,724,182 | A * | 2/1988 | Kato | H01L 23/15 219/543 |
| 4,724,303 | A * | 2/1988 | Martin | H05B 3/0095 219/216 |
| 4,724,305 | A * | 2/1988 | Iimura | H05B 3/0095 219/216 |
| 4,726,822 | A * | 2/1988 | Cates | G01N 30/30 210/198.2 |

(Continued)

FOREIGN PATENT DOCUMENTS

| | | |
|---|---|---|
| EP | 0 967 838 | 12/1999 |
| JP | 2500097 A | 1/1990 |

(Continued)

*Primary Examiner* — Eric Stapleton

(57) ABSTRACT

A heating element and a method of manufacturing the heating element including an aluminum substrate, an electrically insulating layer based on a sol-gel precursor, and an electrically resistive layer with a thickness smaller than 2 μm. The features of this heating element solve the problem of the crack formation due to a mismatch of thermal expansion coefficient of the aluminum substrate and the resistive layer. Also an electrical domestic appliance including the heating element.

17 Claims, 1 Drawing Sheet

(56) References Cited

U.S. PATENT DOCUMENTS 4,780,968 A * 11/1988 Bragagnolo ..... A43B 7/04 219/211
4,889,974 A * 12/1989 Auding ..... H01C 7/021 219/543
4,910,380 A * 3/1990 Reiss ..... B32B 17/10036 15/250.05
4,920,254 A * 4/1990 DeCamp ..... H05B 3/86 219/203
4,950,868 A * 8/1990 Moss ..... A41D 13/0051 219/211
5,569,427 A * 10/1996 Semenova ..... C03C 8/14 106/286.8
5,576,885 A * 11/1996 Lowe ..... C03C 17/3411 219/219
5,587,097 A * 12/1996 Sato ..... H05B 3/16 219/121.68
5,616,263 A * 4/1997 Hyllberg ..... G03G 15/0233 219/469
5,620,621 A * 4/1997 Sontag ..... A41D 19/01535 2/158
5,643,483 A * 7/1997 Kubota ..... H01C 7/003 219/543
5,717,190 A * 2/1998 Inoue ..... G02B 21/30 219/522
5,780,162 A * 7/1998 Toyoda ..... H01L 21/481 257/E23.009
5,786,574 A * 7/1998 Garnett ..... H05B 3/34 126/229
5,822,675 A * 10/1998 Paquet ..... H05B 3/148 219/543
5,827,438 A * 10/1998 Blomberg ..... G01J 3/108 219/543
5,850,072 A * 12/1998 Eckert ..... C22B 21/0084 219/523
5,889,261 A * 3/1999 Boardman ..... C23C 4/02 219/543
5,895,591 A * 4/1999 Kojima ..... G01N 27/4067 204/426
5,916,467 A * 6/1999 Shimada ..... H05B 3/46 219/541
5,925,275 A * 7/1999 Lawson ..... B64D 15/12 219/543
5,945,020 A * 8/1999 Kuroda ..... H05B 3/0095 219/543
6,037,572 A * 3/2000 Coates ..... H05B 3/26 219/451.1
6,072,165 A * 6/2000 Feldman ..... G01K 7/02 136/200
6,225,608 B1 * 5/2001 Kallgren ..... H05B 3/265 219/465.1
6,268,595 B1 * 7/2001 Haenel ..... A61F 7/02 219/211
D445,995 S * 8/2001 Stanley ..... A61F 7/02 D2/614
6,307,192 B1 * 10/2001 Ulfstedt ..... B65D 65/42 219/725
6,358,616 B1 * 3/2002 Jennings ..... C09D 1/02 428/450
6,448,538 B1 * 9/2002 Miyata ..... H05B 3/143 219/444.1
6,486,447 B2 * 11/2002 Miyata ..... H05B 3/143 219/444.1
6,617,554 B2 * 9/2003 Moon ..... A47J 37/0623 219/481
6,777,085 B1 * 8/2004 Argoitia ..... C09C 1/0015 428/328
6,828,032 B2 * 12/2004 Wielstra ..... C09D 183/04 219/543
6,868,230 B2 * 3/2005 Gerhardinger ..... F24H 1/102 219/540
7,002,104 B2 * 2/2006 Gilligan ..... A41D 19/01535 219/211
7,319,207 B2 * 1/2008 Campf ..... H05B 1/0272 219/211
7,605,348 B2 * 10/2009 Byers ..... G02B 7/1815 219/219
2002/0027130 A1 * 3/2002 Miyata ..... H05B 3/143 219/444.1
2002/0155303 A1 * 10/2002 Wielstra ..... C09D 183/04 428/447
2003/0042241 A1 * 3/2003 Uekawa ..... H05B 3/0095 219/216
2003/0057197 A1 * 3/2003 Schmidt ..... B60S 1/026 219/203
2003/0108729 A1 * 6/2003 Yamamoto ..... B32B 18/00 428/209
2004/0170865 A1 * 9/2004 Hamada ..... B32B 7/02 428/690
2005/0053853 A1 * 3/2005 Sugino ..... G03G 5/14726 430/58.05
2005/0285084 A1 * 12/2005 Fujii ..... C09D 11/30 252/500
2006/0051079 A1 * 3/2006 Gerhardinger ..... A47K 10/06 392/435
2006/0138121 A1 * 6/2006 Werkman ..... H05B 3/26 219/543

FOREIGN PATENT DOCUMENTS

JP 3276589 A 12/1991
JP 4357692 A 12/1992
JP 10096846 A 9/1998
JP 2000268942 A 9/2000
JP 2000286044 A 10/2000
JP 2002525829 A 8/2001
JP 2004519832 A 7/2004
WO 0018189 3/2000
WO 02085072 A1 10/2002

* cited by examiner

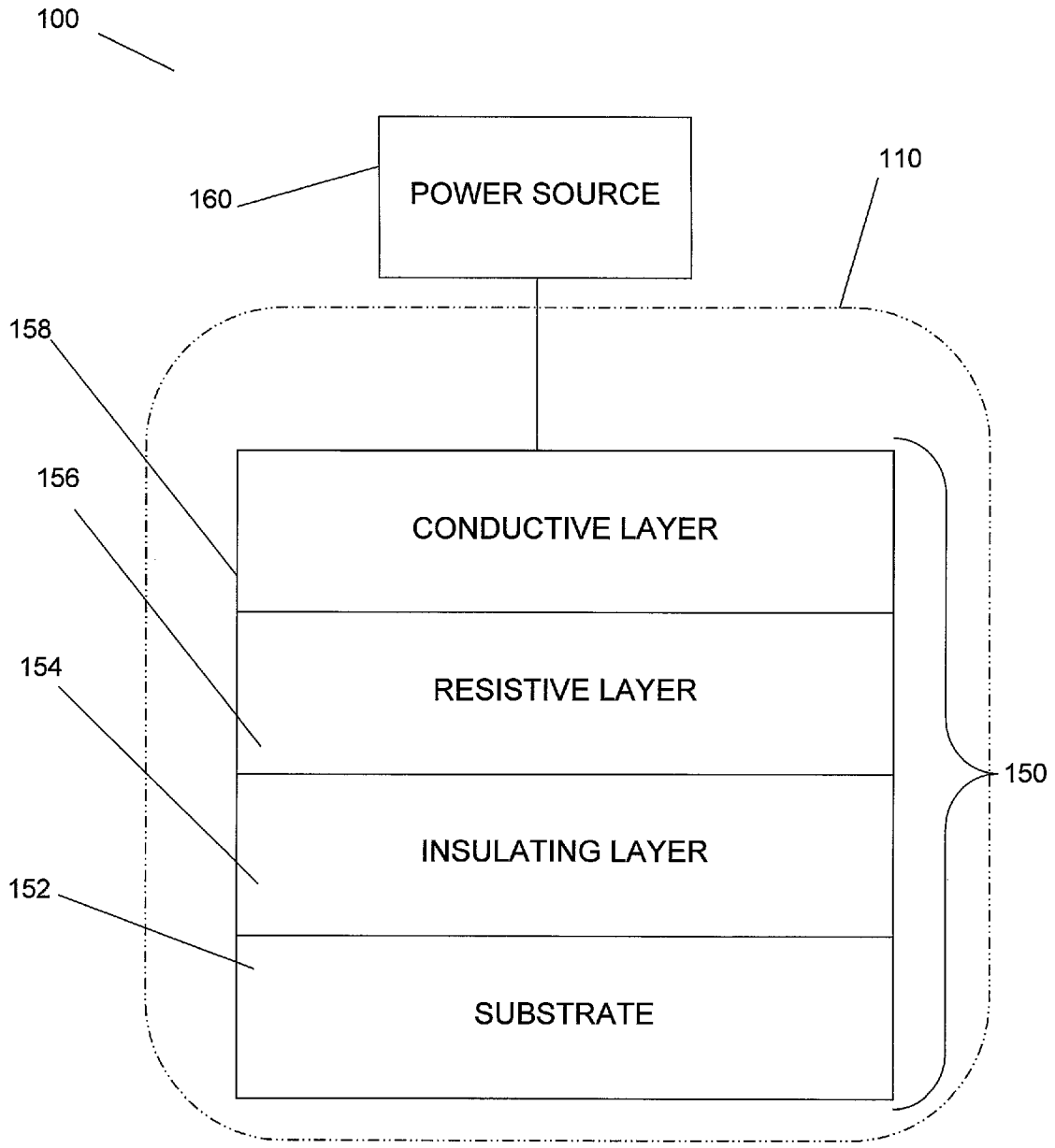
100
160
POWER SOURCE
110
158
156
154
152
CONDUCTIVE LAYER
RESISTIVE LAYER
INSULATING LAYER
SUBSTRATE
150

THIN-FILM HEATING ELEMENT

The present invention relates to a film heating element comprising an aluminum substrate, an electrically insulating layer, and an electrically resistive layer, as well as to an electrical domestic appliance comprising such a heating element.

In general, a film heating element consists of two functional layers applied on a substrate, namely, an electrically insulating layer and an electrically resistive layer. Heat is generated by flow of an electrical current through the resistive layer. The function of the insulating layer is to isolate the heat-generating resistive layer from the metal substrate, which may be directly accessible from the outside.

The resistive layer can be electrically contacted with a supply voltage via highly conductive tracks. These conductive tracks are generally patterned.

Flat-film heating elements can be roughly divided into two main categories, namely thick-film heating elements and thin-film heating elements.

The distinction between these two categories concerns the thickness of the resistive layer. In thick-film heating elements, the resistive layer has a thickness exceeding 2 μm. These films are mainly prepared by means of screen-printing techniques. In thin-film heating elements, the resistive layer has a thickness smaller than 2 μm.

These films are mainly prepared by means of evaporation techniques or via pyrolysis of precursor solutions.

A thin-film heating element is known from U.S. Pat. No. 4,889,974. Said patent discloses a thin-film heating element prepared by means of a wet-chemical process. This thin-film heating element consists of a resistive layer applied directly on an isolating substrate such as a hard glass substrate, a quartz glass substrate, or a ceramic substrate. An $SnO_2$ film doped with acceptor- and donor-forming elements is described as a resistive layer. The films are manufactured from a solution by means of a spray pyrolysis process followed by curing at 600° C.

A number of patents disclose thin-film heaters on electrically conductive substrates, e.g. steel. An insulating layer (e.g. polymer, enamel, etc.) is applied on these electrically conductive substrates in order to insulate the resistive layer from the substrate. A thin resistive layer is applied on top of these insulating layers.

However, until recently no thin-film heaters on aluminum or aluminum alloy substrates have been reported. Aluminum and its alloys have a relatively high coefficient of expansion (22-26 ppm/K) compared to the insulating layers used for steel substrates which are in most cases enamel-based insulators. Insulating layers commonly used for steel substrates cannot be used for aluminum (alloy) substrates. Mismatched thermal expansion coefficients result in cracking of the film when the heating element is exposed to temperature cycles. Furthermore, in order to apply these insulators, the precursors are applied on a suitable substrate, after which the precursor has to be cured at high temperatures above 650° C. in order to obtain a suitable insulating layer. These high curing temperatures exceed or are near to the melting temperature of aluminum (660° C.) and its alloys. Therefore, these materials are not suitable as electrically insulating layers for aluminum substrates.

EP-A-0891118 discloses a thin-film heater in which a ceramic layer is used as an insulating layer for an aluminum substrate. However, the difference in expansion coefficients between the ceramic insulator layer and the aluminum is bridged in this patent in that the heating element is first provided on a stainless steel plate, after which the stainless steel plate is glued to an aluminum plate with e.g. a silicone-based glue.

The invention is explained in further detail, and by way of example, with reference to the accompanying drawing wherein:

FIG. 1 shows a cutaway side view of a domestic appliance including a heating element in accordance with embodiments of the present system.

FIG. 1 shows a cutaway side view (100) of a portion of a domestic appliance (110) including a heating element (150) in accordance with embodiments of the present system. By the drawing, no implication of size or shape is intended including for the heating element (150) and the layers thereof which are provided merely as an illustration to facilitate the discussion herein. As shown, a resistive layer (156) may be applied to the insulating layer (154). The insulating layer (154) may be applied directly to a substrate (152). The heating element (150) according to the invention may further include an electrically conductive layer (158). The electrically conductive layer (158) in the heating element (150) of the invention may include a layer with a relatively low ohmic resistance with respect to the resistive layer (156) and acts as a contacting layer between the resistive layer (156) and an external power source (160). Illustratively and in accordance with embodiments of the present system, the heating element (150) may include the substrate (152) made from anodized aluminum. The insulating layer (154) may include a sol-gel precursor material and non-conductive particles having a flake-like shape. The resistive layer (156) may be formed of a doped metal oxide for example including an aluminum-doped zinc oxide or a tin oxide doped with antimony and may have a thickness smaller than 2 μm. The sol-gee precursor material of the insulating layer (154) may be positioned between the anodized aluminum substrate and the resistive layer (156) and may be positioned in contact with the resistive layer (156) and the anodized aluminum substrate thereby insulating the anodized aluminum substrate from the resistive layer 156. The heating element (150) may further include a conductive layer (158) in contact with the resistive layer (156). The conductive layer (158) for example may include PI/Ag or a sol-gel/Ag paste.

It is an object of the present invention to provide a heating element of the preamble suitable for an aluminum substrate in which no cracks are formed when the element is subjected to temperature cycles. Where the term aluminum is used, it comprises aluminum, anodized aluminum, and alloys of aluminum. Furthermore, the present invention aims to provide an electrical domestic appliance including such a heating element, as well as to a method of manufacturing said heating element.

These and other objects of the invention are achieved by a film heating element, at least comprising an aluminum substrate, an electrically insulating layer which is based on a sol-gel precursor, and an electrically resistive layer with a thickness smaller than 2 μm.

A heating element according to the invention has several advantages. First of all no crack formation is observed when the heating element is exposed to temperature cycles between 20 and 300° C.

Furthermore, the heating element is suitable for high-power applications, with a power density of 20 $W/cm^2$ or higher at a substrate temperature of 300° C.

The film heating element according to the invention comprises an electrically resistive layer with a thickness smaller than 2 μm. This resistive layer preferably comprises a metal, a metal oxide, or a doped metal oxide. A suitable metal is aluminum. Suitable metal oxides are tin oxide, indium-tin oxide (ITO). Suitable doped metal oxides are fluoriné or aluminum-doped zinc oxide, or tin oxides doped with fluorine or antimony.

It was surprisingly found that, although e.g. ITO has a thermal expansion coefficient of about 4 ppm/K compared to about 23 ppm/K for aluminum, no crack formation was observed when the heating element of the invention was exposed to repeated temperature cycles between 20 and 300° C.

The resistive layer may be applied to the insulating layer by means of (atmospheric) chemical vapor deposition ((A) CVD), physical vapor deposition (PVD), magnetron sputtering, thermal spraying, or wet-chemical techniques.

The resistive layer preferably consists of an inorganic material. Suitable inorganic materials are a metal, a metal oxide, and a doped metal oxide. A suitable metal is aluminum. Suitable metal oxides are tin oxide, indium-tin oxide (ITO). Suitable doped metal oxides are fluoriné or aluminum-doped zinc oxide, or tin oxides doped with fluorine or antimony. Resistive layers of an inorganic material do not risk the formation of a carbonized conductive track.

The heating element of the invention further comprises an electrically insulating layer that is based on a sol-gel precursor.

The application of an electrically insulating layer based on a sol-gel precursor provides several advantages. First of all, the sol-gel precursor based layer shows excellent electrical insulating properties. The carbon content of a sol-gel precursor based material is sufficiently low to prevent the formation of a carbonized conductive track in case of failure of the heating, thereby providing a safe heating element. Also, sol-gel materials have a high thermal conductivity which is in the order of magnitude of 0.1-2 W/m/°K. Furthermore, sol-gel precursors can be processed at temperatures below 400° C., which makes this material suitable to be applied directly to aluminum substrates. Due to the lower curing temperature of the hybrid sol-gel precursor, the mechanical properties of the aluminum will be maintained. The sol-gel precursor is preferably applied on an anodized aluminum substrate, to ensure good adhesion of the sol-gel layer.

Although the sol-gel insulating layer is especially suitable for application on aluminum substrates, other substrates which are conventionally used for heating elements and which are compatible with the final utility may also be used. Said substrates may include, for example, stainless steel, enameled steel, or copper. The substrate may be in the form of a flat plate, a tube, or any other configuration that is compatible with the final utility.

Preferably, the sol-gel precursor is a hybrid sol-gel precursor comprising an organosilane compound.

A preferred silane is a silane that forms a hybrid sol-gel precursor. A hybrid sol-gel precursor comprising an organosilane compound is understood to be a compound comprising silicon, which is bonded to at least one non-hydrolysable organic group and 2 or 3 hydrolyzable organic groups.

In an advantageous embodiment, the sol-gel material may also comprise silica particles, in particular colloidal silica particles.

In particular, the hybrid sol-gel precursor comprises an organosilane compound from the group of alkyl-alkoxysilanes.

Preferably, the hybrid sol-gel precursor comprises methyl-trimethoxysilane (MTMS) and/or methyl-triethoxysilane (MTES). An advantage of the heating element of the invention based on the hybrid sol-gel system is a relatively high power density, and optimized thermal expansion coefficient values for aluminum.

Hybrid sol-gel precursors such as MTMS and MTES are known to have an excellent temperature stability up to at least 450° C. Moreover, MTMS has been shown to prevent silver oxidation and subsequent migration effectively. The carbon content of these materials is still low, so carbonized conductive tracks across the insulating layer will not form after failure, making a safe heating element. The maximum layer thickness of coatings made from hybrid precursors is relatively high, compared to the maximum layer thickness of coatings made from non-hybrid sol-gel materials. Therefore, the layers can be deposited in one or at most two steps without intermediate curing.

Advantageously, the electrically insulating layer comprises non-conductive particles.

A fraction of said non-conductive particles preferably has a flake-like shape and a longest dimension of 2-500 μm, preferably from 2 to 150 μm, and more preferably from 5 to 60 μm. These flake-like non-conductive particles are based on oxides such as, for example, mica or clay, and/or surface-modified mica or clay particles with a coating of titanium dioxide, aluminum oxide, and/or silicon dioxide. The flake-like material content in the insulating layer should be less than 20 vol %, preferably less than 15 vol %, and more preferably less than 4-10 vol %. An advantage of such anisotropic particles is that their presence prevents the formation of cracks in the electrically insulating layer after frequent heating up and cooling down of the element.

In the preferred embodiment, the non-conductive particles are present in colloidal form. Examples thereof are oxides like aluminum oxide and silicon dioxide. Preferably, the aluminum oxide content in the insulating layer should be less than 40 vol %, preferably less than 20 vol %, and more preferably 10-15 vol %. As for the silicon dioxide content in the insulating layer, it should advantageously be less than 50 vol %, preferably less than 35 vol %, and more preferably less than 15-25 vol %.

If an insulating layer is based on MTMS or MTES filled with particles, including anisotropic particles, a layer thickness of just 50 μm can withstand 5000V. This relatively small layer thickness allows the temperature difference across the thickness of the resistive layer to be fairly low, which allows for a much lower temperature of the heating resistive layer for obtaining a certain temperature of the aluminum substrate. For this reason said thin layers are advantageously used. The layers may be applied by any wet-chemical application method, preferably spray coating or screen-printing followed by a curing step.

The heating element according to the invention may further comprise an electrically conductive layer. The electrically conductive layer in the heating element of the invention comprises a layer with a relatively low ohmic resistance with respect to the electrically resistive layer and acts as a contacting layer between the heat-generating resistive layer and an external power source.

The conductive layer may consist of a metal, e.g. aluminum, or of a hybrid material such as PI/Ag, or a sol-gel/Ag paste. The conductive layer may be applied by means of (A)CDV, PVD, magnetron sputtering, thermal spraying, and wet-chemical or screen printing techniques.

The preferred technique for applying the conductive tracks is screen printing. Commercially available metal powders may be used for the conductive track. It is preferred to use silver or silver alloy particles Other metals and semiconductors may be used in making conductive layers for the application, provided they have a sufficiently high temperature stability in the sol-gel matrix. The use of MTMS or MTES precursors reduces the rate of oxidation of silver and graphite particles at high temperatures of the heating element. In that respect it has been noted that graphite in an MTES derived matrix has shown a stability of more than 600 hours at 320° C.

To make the formulations screen-printable, a cellulose derivative may be added to the particle-containing, hydrolyzed MTMS or MTES solution. Hydroxyl-propylmethyl cellulose is preferably used as the cellulose material. Finally, a solvent with a high boiling point is added to prevent drying of the ink and subsequent clogging of the screen. Butoxyethanol was found to be a suitable choice, but other polar solvents, preferably alcohols, are also found appropriate.

Optionally, the element may be covered with a protective topcoat layer. This topcoat layer mainly serves as a protective layer against mechanical damage during handling of the element. With the use of, for instance, silica-filled hybrid sol-gel solution, for example based on MTMS, a screen-printable formulation can be easily made. The applied topcoat layer may be co-cured with the conductive layer and the resistive layer.

The invention further relates to an electrical domestic appliance comprising at least the heating element of the invention. Heating elements of the present invention are very suitable for heating elements in laundry irons, especially for the controlled formation of steam, for which high power densities are required. However, the heating elements are also very suitable for other domestic applications like hair dryers, hair stylers, steamers and steam cleaners, garment cleaners, heated ironing boards, facial steamers, kettles, pressurized boilers for system irons and cleaners, coffee makers, deep-fat fryers, rice cookers, sterilizers, hot plates, hot-pots, grills, space heaters, waffle irons, toasters, ovens, or water flow heaters.

The invention also relates to a method of manufacturing a heating element according to the invention, at least comprising the steps of: providing an aluminum substrate; applying an electrically insulating layer on said substrate; and applying a resistive layer on top of the electrically insulating layer, characterized in that the electrically insulating layer is obtained by means of a sol-gel process and the resistive layer has a thickness smaller than 2 μm. In particular, the sol-gel process at least comprises the step of mixing an organosilane compound with water.

The invention will be further elucidated in the following manufacturing example.

EXAMPLE

A 200 nm thin layer (72*64 mm) of ITO (90 wt % $In_2O_3$, 10 wt % $SnO_2$ purity more than 99.99%) was applied by means of DC magnetron sputtering in an argon/oxygen atmosphere with a Leybold Z650 Batch system (starting initial pressure below $4.0*10^{-6}$ mBar, deposition speed 20 nm/min) onto a 50 μm thick insulating layer based on a sol-gel precursor on an aluminum substrate. Conductive layers (Pl/Ag-based paste, PM437 by Acheson) of about 10 μm thick were applied by means of screen printing. After drying for 30 minutes at 80° C., the conductive layer was cured for 30 minutes at 375° C. in an air atmosphere. The resulting resistance is about 36 Ω with a surface resistance of 0.27 Ω/□ (for a 25.5 μm thick layer)

After application of a voltage, the resulting heating element operates with a power density of 20 W/cm$^2$ at a substrate temperature setting of 240° C.

The invention claimed is:

1. A heating element, comprising an anodized aluminum substrate, an electrically insulating layer including a sol-gel precursor material and non-conductive particles having a flake-like shape, and a thin-film electrically resistive layer of a doped metal oxide including one of an aluminum-doped zinc oxide and a tin oxide doped with antimony with a thickness smaller than 2 μm, with the sol-gel precursor material of the electrically insulating layer positioned between the anodized aluminum substrate and the thin-film electrically resistive layer and in contact with the thin-film electrically resistive layer and the anodized aluminum substrate thereby insulating the anodized aluminum substrate from the thin-film electrically resistive layer.

2. The heating element as claimed in claim 1, wherein the sol-gel precursor material is a hybrid sol-gel material comprising an organosilane compound from a group of alkyl-alkoxysilanes.

3. The heating element as claimed in claim 1, wherein the sol-gel precursor material comprises methyl-trimethoxysilane or methyl-triethoxysilane.

4. The heating element as claimed in claim 1, wherein the heating element further comprises a conductive layer comprising one of Pl/Ag and a sol-gel/Ag paste in contact with the thin-film electrically resistive layer.

5. An electrical domestic appliance comprising a heating element comprising an anodized aluminum substrate, an electrically insulating layer including a sol-gel precursor material and non-conductive particles having a flake-like shape, and a thin-film electrically resistive layer of a doped metal oxide including one of an aluminum-doped zinc oxide and a tin oxide doped with antimony with a thickness smaller than 2 μm, with the sol-gel precursor material of the electrically insulating layer positioned between the anodized aluminum substrate and the thin-film electrically resistive layer and in contact with the thin-film electrically resistive layer and the anodized aluminum substrate thereby insulating the anodized aluminum substrate from the thin-film electrically resistive layer.

6. The electrical domestic appliance according to claim 5, wherein the electrical domestic appliance comprises one of a steam iron, a hair dryer, a hair styler, a steamer and a steam cleaner, a garment cleaner, a heated ironing board, a facial steamer, a kettle, a pressurized boiler for system irons and cleaners, a coffee maker, a deep-fat fryer, a rice cooker, a sterilizer, a hot plate, a hot-pot, a grill, a space heater, a waffle iron, a toaster, an oven, or a water flow heater.

7. A method of manufacturing a heating element, the method comprising acts of: providing an anodized aluminum substrate; applying an electrically insulating layer including a sol-gel precursor material and non-conductive particles having a flake-like shape on said anodized aluminum substrate by a sol-gel process; and applying a thin-film resistive layer of a doped metal oxide including one of an aluminum-doped zinc oxide and a tin oxide doped with antimony having a thickness smaller than 2 μm directly on top of the electrically insulating layer thereby insulating the anodized aluminum substrate from the thin-film resistive layer, wherein the sol-gel precursor material of the electrically insulating layer is in contact with the thin-film electrically resistive layer and the anodized aluminum substrate.

8. The heating element as claimed in claim 1, wherein the thin-film electrically resistive layer comprises a metal oxide including one of a tin oxide and indium-tin oxide (ITO).

9. The method as claimed in claim 7, wherein the act of applying the thin-film resistive layer to the electrically insulating layer comprises an act of performing one of magnetron sputtering, thermal spraying, and wet-chemical deposition techniques of the thin-film resistive layer.

10. The heating element as claimed in claim 1, wherein the sol-gel precursor material comprises silicon bonded to at least one non-hydrolysable organic group and 2 or 3 hydrolyzable organic groups.

11. The heating element as claimed in claim 1, wherein the sol-gel precursor material comprises colloidal silica particles.

12. The heating element as claimed in claim 1, wherein the non-conductive particles comprise a longest dimension of from 2 to 150 μm.

13. The heating element as claimed in claim 12, wherein the non-conductive particles comprise a longest dimension of from 5 to 60 μm.

14. The heating element as claimed in claim 1, wherein the non-conductive particles comprise less than a 15% volume of the electrically insulating layer.

15. The heating element as claimed in claim 14, wherein the non-conductive particles comprise from 4-10% volume of the electrically insulating layer.

16. The heating element as claimed in claim 1, wherein the non-conductive particles are present in the electrically insulating layer in colloidal form.

17. The heating element as claimed in claim 3, wherein the sol-gel precursor material further comprises hydroxylpropylmethyl cellulose and butoxyethanol.

* * * * *